US009015967B2

(12) United States Patent
May

(10) Patent No.: US 9,015,967 B2
(45) Date of Patent: Apr. 28, 2015

(54) ADJUSTABLE BLADE RAKE

(75) Inventor: Michael P. May, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 183 days.

(21) Appl. No.: 13/333,147

(22) Filed: Dec. 21, 2011

(65) Prior Publication Data

US 2013/0160334 A1 Jun. 27, 2013

(51) Int. Cl.

| | |
|---|---|
| ***E02F 3/96*** | (2006.01) |
| ***E02F 3/815*** | (2006.01) |
| ***E02F 3/76*** | (2006.01) |

(52) U.S. Cl.

CPC ..... *E02F 3/8155* (2013.01); *E02F 3/7627* (2013.01); *E02F 3/7631* (2013.01)

(58) Field of Classification Search

CPC ..... E02F 3/8155
USPC ..... 37/405, 403, 407; 172/777; 414/724
See application file for complete search history.

(56) References Cited

U.S. PATENT DOCUMENTS

| | | | | | |
|---|---|---|---|---|---|
| 2,042,196 | A | * | 5/1936 | Senz | 172/777 |
| 2,262,415 | A | | 11/1941 | Williams et al. | |
| 2,577,977 | A | * | 12/1951 | Nelson | 414/724 |
| 2,597,374 | A | * | 5/1952 | Richey | 414/724 |
| 2,612,280 | A | * | 9/1952 | Stueland | 414/722 |
| 2,869,257 | A | | 1/1959 | Braukly | |
| 2,899,760 | A | * | 8/1959 | Armington et al. | 172/777 |
| 2,984,029 | A | * | 5/1961 | Pederson | 172/777 |
| 2,993,285 | A | * | 7/1961 | Hoxie | 172/777 |
| 3,034,237 | A | * | 5/1962 | Wolfe et al. | 37/405 |
| 3,111,777 | A | * | 11/1963 | Prater | 37/405 |
| 3,362,554 | A | * | 1/1968 | Fortier | 414/703 |
| 3,528,509 | A | * | 9/1970 | Den Bleyker | 172/815 |
| 3,795,070 | A | * | 3/1974 | Bronson et al. | 37/405 |
| 3,896,568 | A | * | 7/1975 | Hancock | 37/449 |
| 4,364,191 | A | | 12/1982 | Cazes | |
| 4,407,080 | A | | 10/1983 | Mann | |
| 4,512,090 | A | * | 4/1985 | Billings | 37/405 |
| 4,967,850 | A | * | 11/1990 | Bargfrede et al. | 172/197 |
| 5,407,014 | A | * | 4/1995 | Tranmer | 172/197 |
| 5,906,243 | A | * | 5/1999 | Clausen | 172/33 |
| 6,092,606 | A | * | 7/2000 | Basler | 171/63 |
| 6,283,224 | B1 | * | 9/2001 | Culver et al. | 172/685 |
| 6,572,324 | B2 | * | 6/2003 | Ihm | 414/723 |
| 6,718,662 | B1 | * | 4/2004 | Schaff | 37/405 |
| 6,763,618 | B1 | | 7/2004 | Moran | |
| 6,892,824 | B2 | * | 5/2005 | Torrey | 172/701.3 |
| 7,478,682 | B1 | * | 1/2009 | Keigley | 172/145 |
| 7,641,436 | B2 | * | 1/2010 | Wippel et al. | 414/724 |
| 7,891,121 | B2 | * | 2/2011 | Smoljo | 37/447 |
| 2009/0188684 | A1 | | 7/2009 | Parrish | |

* cited by examiner

*Primary Examiner* — Jamie L McGowan
(74) *Attorney, Agent, or Firm* — Baker A. Fisher; BakerHostetler

(57) ABSTRACT

An adjustable blade rake includes a mounting plate configured to mount to a machine. A backup plate is coupled to the mounting plate and includes a plurality of slots. A moldboard is attached to the backup plate. A plurality of tines are slidably located in the plurality of slots adjacent the rear side of the moldboard. A crossbar couples the plurality of tines together and a lifting device is operatively coupled to the plurality of tines and is configured to slide the plurality of tines in the plurality of slots.

20 Claims, 12 Drawing Sheets

ADJUSTABLE BLADE RAKE

TECHNICAL FIELD

The present disclosure relates generally to a machine work tool. Specifically, the present disclosure relates to an adjustable blade rake tool for a machine.

BACKGROUND

Machines, such as track-type tractors, wheel dozers, track-type loaders, skid steer loaders, multi-terrain loaders, compact track loaders, track loaders, wheel loaders, wheel-tractor scrapers, as well as other machines, are often used in materials handling, construction, and other industries. These machines may include a blade, such as a dozing-type blade, for moving the materials such as soil, rock, sand, garbage, brush, and any other movable material.

From time to time it becomes desirable to use the machine to perform raking operations to the material. Traditionally, in this situation an operator removes the blade from the machine and installs a rake tool in place of the blade. This is a difficult process and requires a lot of time to change the blade and rake each time the user wants to perform the other operation. Other solutions include mounting a rake to a front side of the blade such that the rake tines are below the lower surface of the blade. This type of rake system is in the way and must be removed if the user of the machine wants to use the blade for dozing without the rake. Still other solutions included pivotably pinning a rake to the front side of the blade such that the rake can be pivoted down so that the tines are below the lower surface of the blade when raking is desired and then the rake can be pivoted up so that the blade can be used for dozing. However, this type of system obstructs the operator's view to see over the blade when the rake is pivoted up and extends above the upper surface of the blade.

Another solution is provided in U.S. Pat. No. 4,364,191 to Cazes (the '191 patent). The '191 patent discloses a piling rake having a blade connectable to a tractor. The rake includes a plurality of teeth extending from the bottom of the blade. The teeth are pivotably connected to permit rearward pivotal movement of the teeth away from objects encountered when the tractor moves. Fluid piston and cylinder combinations interconnect the teeth with the blade so movement of the teeth displaces pressurized fluid within the piston and cylinder combinations. The pressurized fluid reverses the pivotal movement of the teeth when the teeth clear the objects. However, this system does not allow the user to adjust a raking depth of the rake tines and must be removed from the blade when the user wants to use the blade without the rake.

In view of the above, it is desirable to provide a more versatile integral adjustable blade rake. Thus, the present disclosure is directed to overcoming one or more of the problems discussed above.

SUMMARY

In one aspect, the present disclosure provides an adjustable blade rake. According to an embodiment, the adjustable blade rake includes a mounting plate configured to mount to a machine. A backup plate is coupled to the mounting plate and includes a plurality of slots. A moldboard is attached to the backup plate. A plurality of tines are slidably located in the plurality of slots adjacent to the rear side of the moldboard. A crossbar couples the plurality of tines together and a lifting device is operatively coupled to the plurality of tines and is configured to slide the plurality of tines in the plurality slots.

Another aspect of the present disclosure provides a hydraulic rake system. According to an embodiment, the hydraulic rake system includes a mounting plate configured to mount to a machine. A backup plate having a plurality of slots is coupled to the mounting plate. A moldboard is attached to the backup plate. A plurality of tines are slidably located in the plurality of slots adjacent to a rear side of the moldboard. A crossbar couples the plurality of tines together. A hydraulic cylinder is operatively coupled to the plurality of tines and configured to slide the plurality of tines in the plurality slots between a retracted position and an extended position.

In yet another aspect the present disclosure provides a machine. According to an embodiment, the machine includes a frame, an engine supported by the frame, and a propulsion system coupled to the frame and the engine. The propulsion system is configured to propel the machine. An adjustable blade rake is coupled to the frame. The adjustable blade rake includes a mounting plate. A backup plate having a plurality of slots is coupled to the mounting plate. A moldboard is attached to the backup plate. A plurality of tines is slidably located in the plurality of slots adjacent to a rear side of the moldboard. A crossbar couples the plurality of tines together. A lifting device is operatively coupled to the plurality of tines. The lifting device is configured to slide the plurality of tines in the plurality slots.

Other features, aspects, and advantages of this disclosure will be apparent from the following description and the accompanying drawings.

BRIEF DESCRIPTION OF THE DRAWINGS

The drawings illustrate exemplary embodiments of the disclosure and when accompanied with the description provided herein serve to explain the present disclosure by way of example and should not be construed to limit the present disclosure.

DETAILED DESCRIPTION

The present disclosure relates generally to a machine work tool. Specifically, the present disclosure relates to an adjustable blade rake configured to couple to a machine. The blade rake assembly includes an adjustable depth feature that allows use of the blade, the rake, or the blade and rake in combination, without the need to remove the blade to add a rake and also without the need to assemble and disassemble a traditional pivoting rake to the blade.

For example, in one embodiment, a machine operator can operate the blade, the rake, or the blade and the rake in combination by extending and retracting hydraulic cylinders configured to raise and lower the rake tines, which are embedded with structural backup plates behind the blade moldboard. The operator can control the depth of the rake infinitely within the range of rake travel using the hydraulic cylinder. In an alternative embodiment, a manual version is configured such that the rake tine depth adjustment is made at specific intervals by pinning the tines at selected heights.

Accordingly, the adjustable blade rake of the present disclosure provides a compact rake design, which does not require removal from the blade to use the blade, and does not interfere with the operators view above and in front of the blade as do traditional rakes. The rake may be used for moving brush, raking soil, and other materials with the tines fully extended. Additionally, the rake may be used with the tines slightly extended as an aid in ripping soil and/or sod when dozing hard earth. Furthermore, the blade may be used without the rake tines when the tines are fully retracted.

Figure 1:
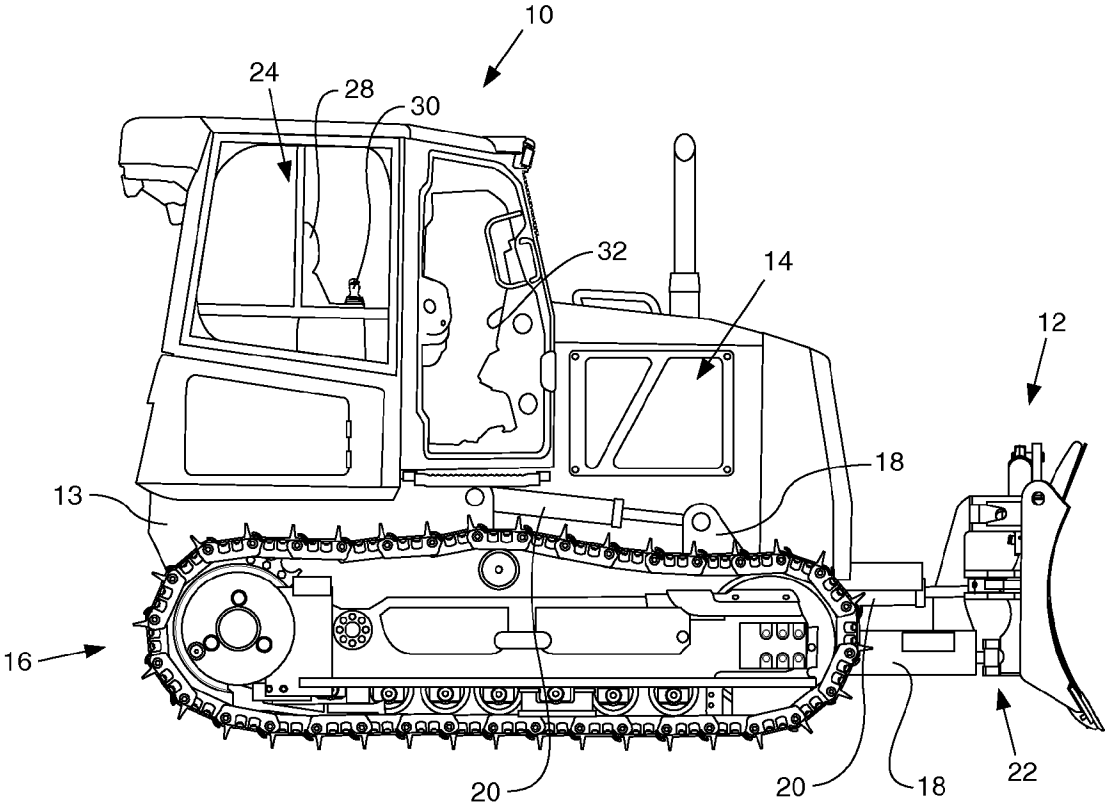
FIG. 1 illustrates a side view of a machine configured with an adjustable blade rake according to an embodiment of the present disclosure.

FIG. 1 illustrates a side view of a machine 10 configured with an adjustable blade rake 12 according to an embodiment of the present disclosure. The machine 10 illustrated in FIG. 1 and discussed in this disclosure is generally known as a track-type tractor. However, it should be readily understood by those having ordinary skill in the art that the systems of the present disclosure can be used on other machines such as wheel dozers, track-type loaders, skid steer loaders, multi-terrain loaders, compact track loaders, track loaders, wheel loaders, wheel-tractor scrapers, as well as other machines. As should also be understood, such machines may be used in materials handling, construction, and other industries. Machine 10 includes the adjustable blade rake 12, having a blade, such as a dozing-type blade, for moving the materials such as soil, rock, sand, garbage, brush, and any other movable material.

Machine 10 includes a frame 13, a power system 14, and a propulsion system 16. The frame 13 may take many different forms as will be recognized by those having ordinary skill in this art. For example, the frame 13 may be a rigid frame, a flexible frame, an articulating frame, or any other type of frame/frame assembly capable of supporting machine 10. In addition, it should be readily understood that the frame 13 may be configured to mate with a machine undercarriage system (as shown with the propulsion system 16 of the track-type tractor in FIG. 1).

The power system 14 may include an engine such as, a diesel engine, a gasoline engine, a gaseous fuel-powered engine or any other type of combustion engine. It is contemplated that power system 14 may alternatively embody a non-combustion source of power such as a fuel cell, a power storage device, or any other type of power source. Power system 14 produces a mechanical or electrical power output that is then converted to mechanical, hydraulic, electrical, and/or other power for operating machine 10.

The propulsion system 16 includes a track-drive system incorporated with the machine undercarriage. In an alternative embodiment, the propulsion system 16 may include a wheel-drive system, or any other type of drive system to propel the machine 10. The propulsion system 16 may also include a transmission, a fluid pump (e.g., hydraulic system), and/or other devices to convert energy from the power system 14 to propel the machine 10 using the propulsion system 16. The propulsion system 16, including the undercarriage, is configured to receive power from the power system 14 and to convert that power to movement to propel the machine 10.

The machine 10 may further include one or more lift arms 18 pivotably coupled to the machine 10. One or more hydraulic cylinders 20 are operatively coupled between the frame 13 and the lift arms 18 to raise, lower, pivot, or otherwise manipulate the lift arms 18 and the adjustable blade rake 12. A hydraulic system (not shown) utilizes power from the power system 14 to generate pressurized fluid to operate the hydraulic system (including the hydraulic cylinders 20).

A coupler 22 may be coupled to the lift arms 18. The coupler 22 is configured to selectively attach to a work tool, such as the adjustable blade rake 12, as shown in FIG. 1. Construction and operation of the lift arms 18, hydraulic cylinder 20, and coupler 22 should be understood by those having ordinary skill in the art.

Machine 10 further includes an operator station 24 supported by the frame 13. The operator station 24 is configured to hold an operator of the machine 10, and includes control devices configured to allow the operator to control operations of the machine 10 from the operator station 24. The operator station 24 may be open or may be enclosed within a cab, as desired.

The operator station 24 includes a seat 28, one or more operator interface device(s) 30 and one or more control panel(s) 32. The seat 28 is operatively coupled to the frame 13 and is configured to support the operator during operation of the machine 10. An operator interface device 30, such as a joystick, steering wheel, lever, knob, button, switch, and/or a variety of other interface devices receive input, such as motion, pressure, and etc., from the operator and communicate that input for controlling operation of the machine 10.

In operation, the operator sits in the seat 28 and manipulates one or more operator interface device(s) 30 (e.g., configured as joysticks having buttons, switches, and/or knobs), which causes the machine 10 to travel using the propulsion system 16 powered by the power system 14. In addition, manipulation of the operator interface device(s) 30 may cause the hydraulic system to operate the hydraulic cylinder(s) 20, which pivots the lift arm(s) 18, with respect to the frame 13 of the machine 10 to raise, lower, and/or pivot adjustable blade rake 12.

Figure 2A:
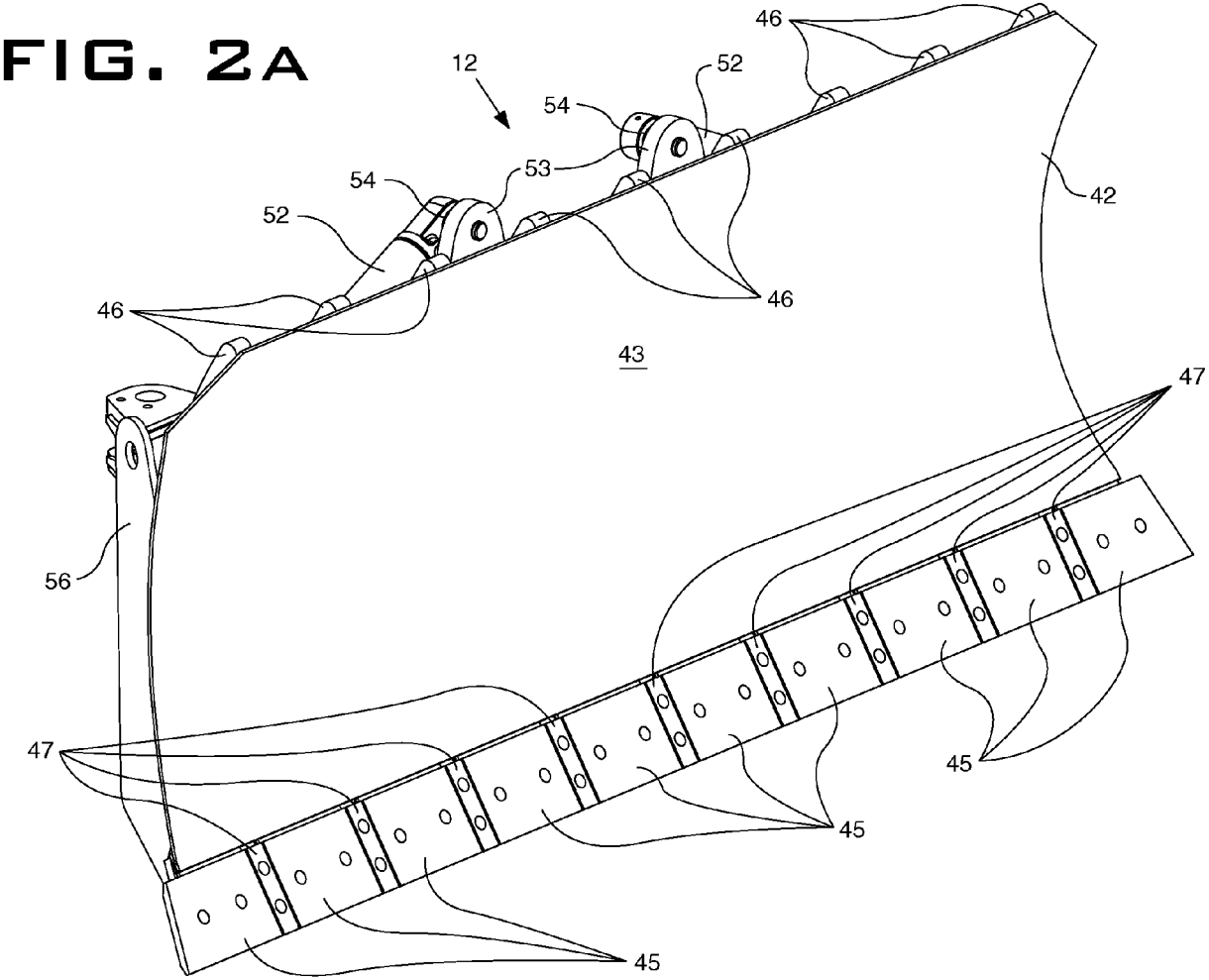
FIGS. 2A, 2B, and 2C illustrate various isometric views of an embodiment of the adjustable blade rake of FIG. 1 having the rake tines fully retracted.
Figure 2B:
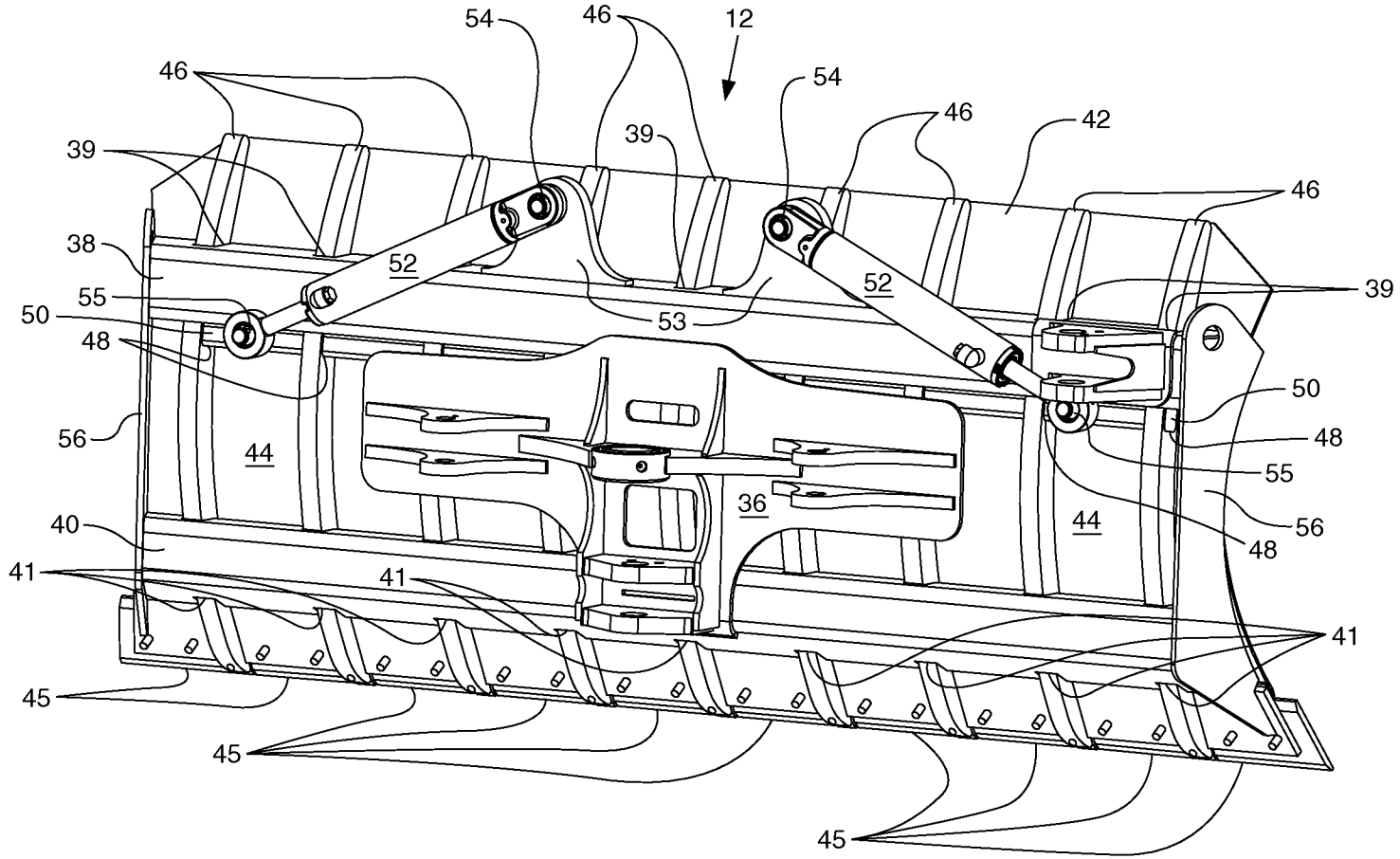
Figure 2C:
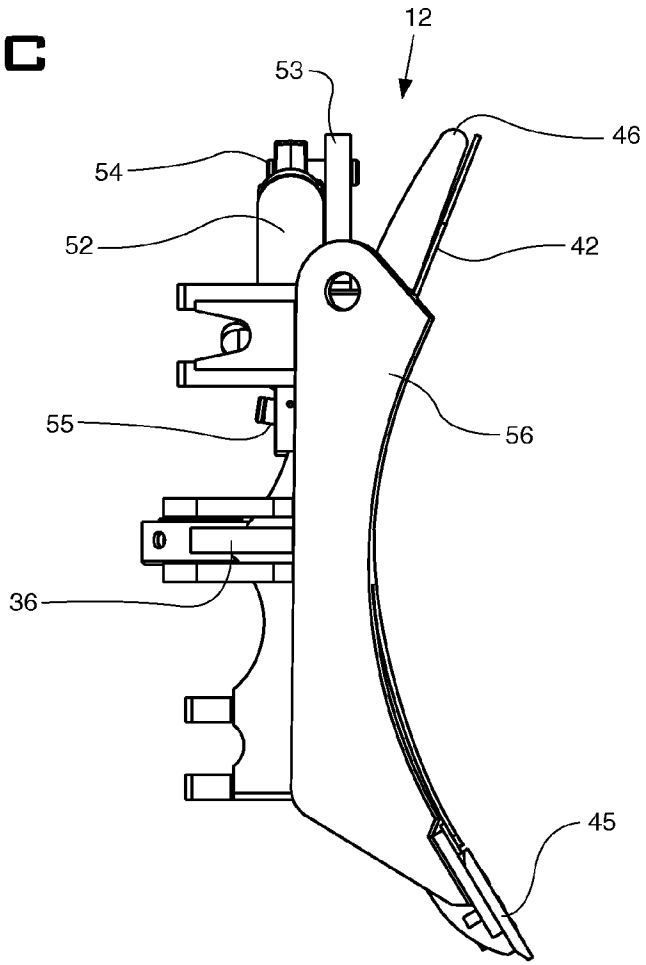

FIGS. 2A, 2B, and 2C illustrate various isometric views of an embodiment of the adjustable blade rake 12 having the rake tines fully retracted. The adjustable blade rake 12 includes a mounting plate 36 that is configured to mount to machine 10. The mounting plate 36 is formed of a rigid material, such as steel, iron, or other material, and includes structural supports, brackets, fittings, bushings, bearings, and/or a variety of other features that allow the mounting plate 36 to mount to machine 10. The mounting plate 36 may be configured to mount directly or indirectly to lift arm(s) 18, hydraulic cylinder 20, and/or coupler 22. However, the shape and form of the mounting plate 36 may vary with various different machines to which the adjustable blade rake 12 is to mount. The mounting plate 36 is structurally sufficient to handle the compression, stress and/or other forces expected to be applied to the mounting plate 36 when machine 10 moves adjustable blade rake 12 through a material.

An upper backup plate 38 and a lower backup plate 40 are attached to the mounting plate 36. The backup plates 38, 40 are formed of a rigid material, such as steel, iron, or other material, and are configured to support a moldboard 42. The backup plates 38, 40 may be formed in a solid material, a channel material, a bent sheet material, or in any desired base material such that they are structurally sufficient to handle the compression, stress and/or other forces expected to be applied to the backup plates 38, 40 when machine 10 moves adjustable blade rake 12 through a material. The backup plates 38, 40 may be attached to the mounting plate 36 via welding, fastening, riveting, or by other fixed or removable connecting means. In alternative embodiments, the adjustable blade rake 12 may include any number of backup plates and the shape and form of the backup plates 38, 40 may vary as desired.

Upper backup plate 38 includes a plurality of slots 39 formed through the backup plate 38. Similarly, lower backup plate 40 includes a plurality of slots 41 formed through the backup plate 40. The slots 39 in the upper backup plate 38 and the slots 41 in the lower backup plate 40 are generally aligned with one another.

The moldboard 42 is configured to engage, dig, or otherwise receive material, such as soil, rock, gravel, and/or other materials (not shown) to be moved by machine 10. The moldboard 42 is formed of a rigid material, such as steel, iron, or other material and has a front side 43 and a rear side 44. The rear side 44 is attached fixedly or removably to the backup plates 38 and 40 via welding, fastening, riveting, or other suitable means. Thus, the front side 43 receives and moves material when lowered to a position to engage the material and when machine 10 is traveling generally in a forward direction. To efficiently move the material, moldboard 42 is generally formed having an arcuate profile shape, such as that shown in the side view of FIG. 2C. Such arc or radius shape allows the moldboard 42 to engage, push, and roll the material as the material moves up the moldboard 42 and tumbles forward while machine 10 moves in the forward direction. However, it is contemplated that the profile shape of the moldboard 42 may be other shapes.

To increase the longevity or the usable life of the moldboard 42, one or more ground engaging tool(s) 45 formed of an alloy of metallic ground engaging materials are attached to the ground engaging or lower edge of the moldboard 42. The ground engaging tool(s) may be replaceable and may be attached to the moldboard 42 via bolting, riveting, welding, or other suitable attaching means. As should be understood by those having ordinary skill in the art, ground-engaging materials generally have a hardness and an abrasive wear resistance, which are harder and more durable than materials used in forming non-wear portions of the adjustable blade rake 12. The moldboard 42 may be formed with or without the ground engaging tool(s) 45.

The adjustable blade rake 12 includes a number of rake tines 46 integrated into the structural supports of the adjustable blade rake 12. The tines 46 are formed of a rigid material, such as steel, iron, or other material. The tines 46 are slidably located in slots 39 and 41 of backup plates 38 and 40 adjacent to the rear side 44 of the moldboard 42. In an embodiment, the tines 46 are generally formed with a front side having an arcuate profile shape substantially similar to that of the rear side 44 of the moldboard 42. Accordingly, the tines 46 nest or otherwise fit compactly with the moldboard 42. It is contemplated that the profile shape of the tines 46 may be other shapes.

Similar to the moldboard 42, the tines 46 may include ground engaging tools 47 formed of a ground engaging material attached to the ground engaging or lower edge of the tines 46. The ground engaging tools 47 may be fixedly attached via welding or may be removably attached via fasteners to the tines 46. In an alternative embodiment, the tine 46 may be entirely formed of a ground engaging material.

The tines 46 each have a tine crossbar aperture 48 formed through the tine 46. The aperture 48 is formed to receive crossbar 50 through the aperture of each of the tines 46 and thus, tie all of the tines together. As such, the tines 46 all slide or otherwise move substantially together in the respective slots 39 and 41 adjacent the rear side 44 of the moldboard 42. The crossbar 50 is formed of a rigid material, such as steel, iron, or other material. In an alternative embodiment, the crossbar 50 is attached to the tines 46 via a means, other than through an aperture, such as welding or fastening (not shown).

Figure 3A:
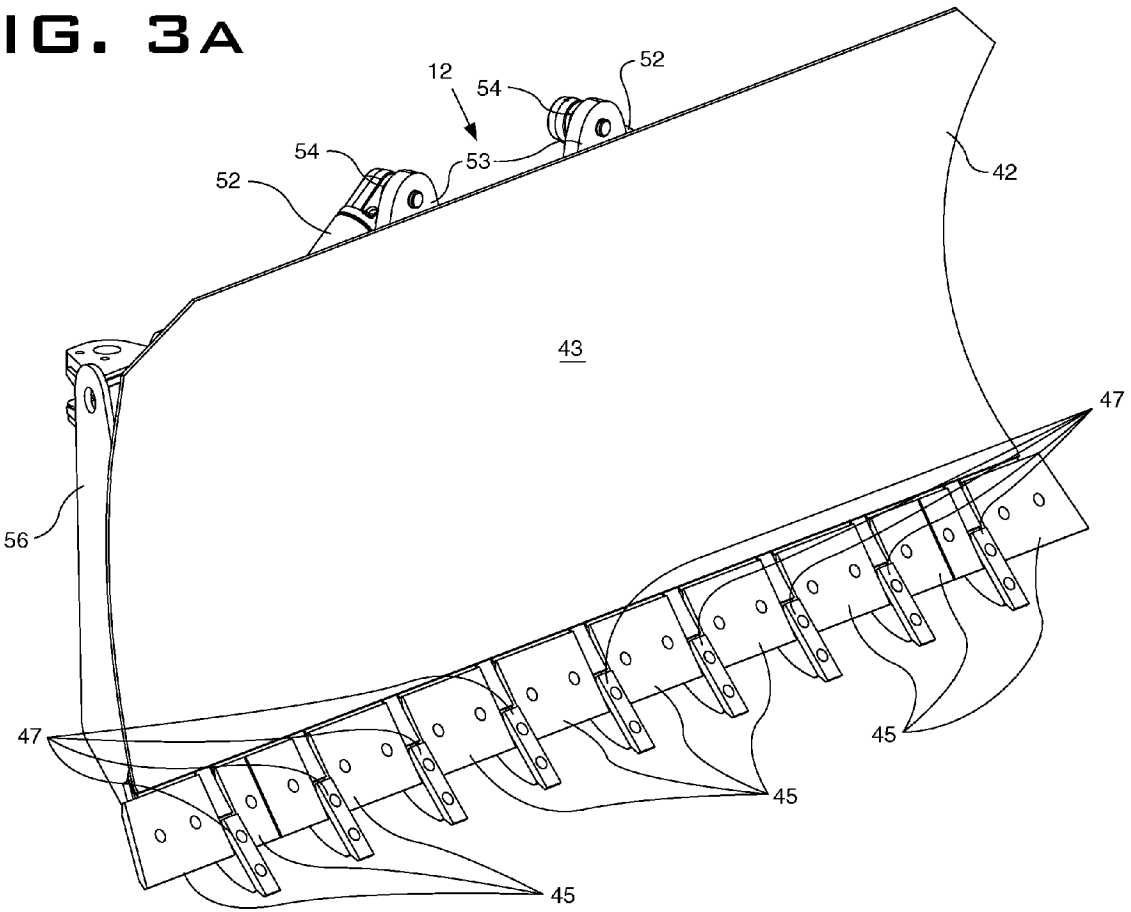
FIGS. 3A, 3B, and 3C illustrate various isometric views of an embodiment of the adjustable blade rake of FIG. 1 having the rake tines partially extended.
Figure 3B:
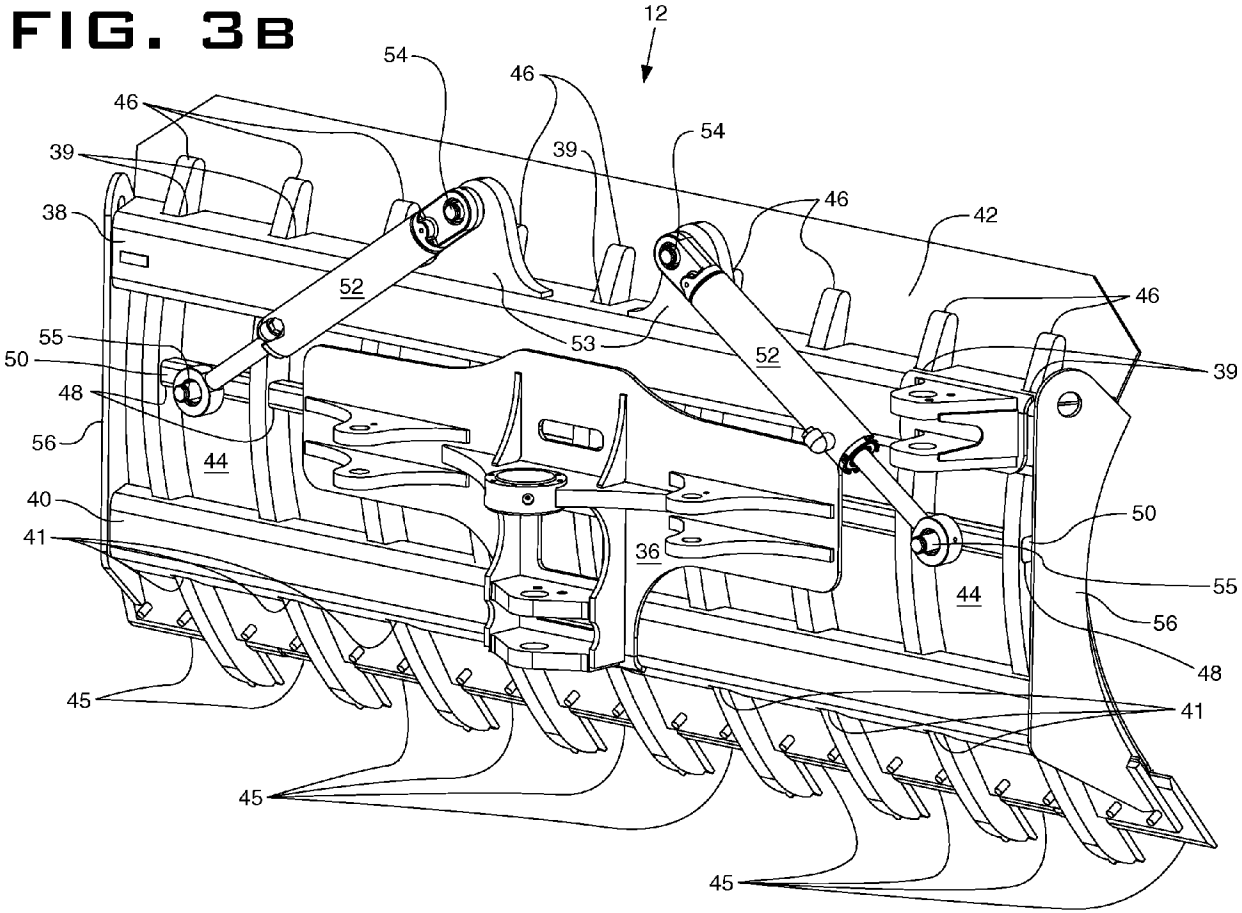
Figure 3C:
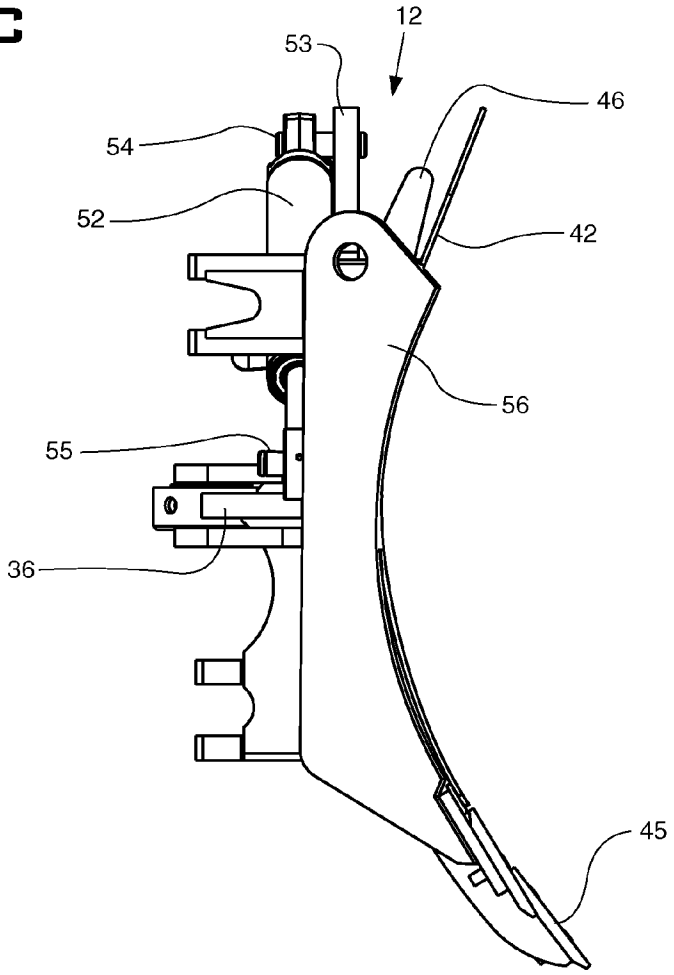
Figure 4A:
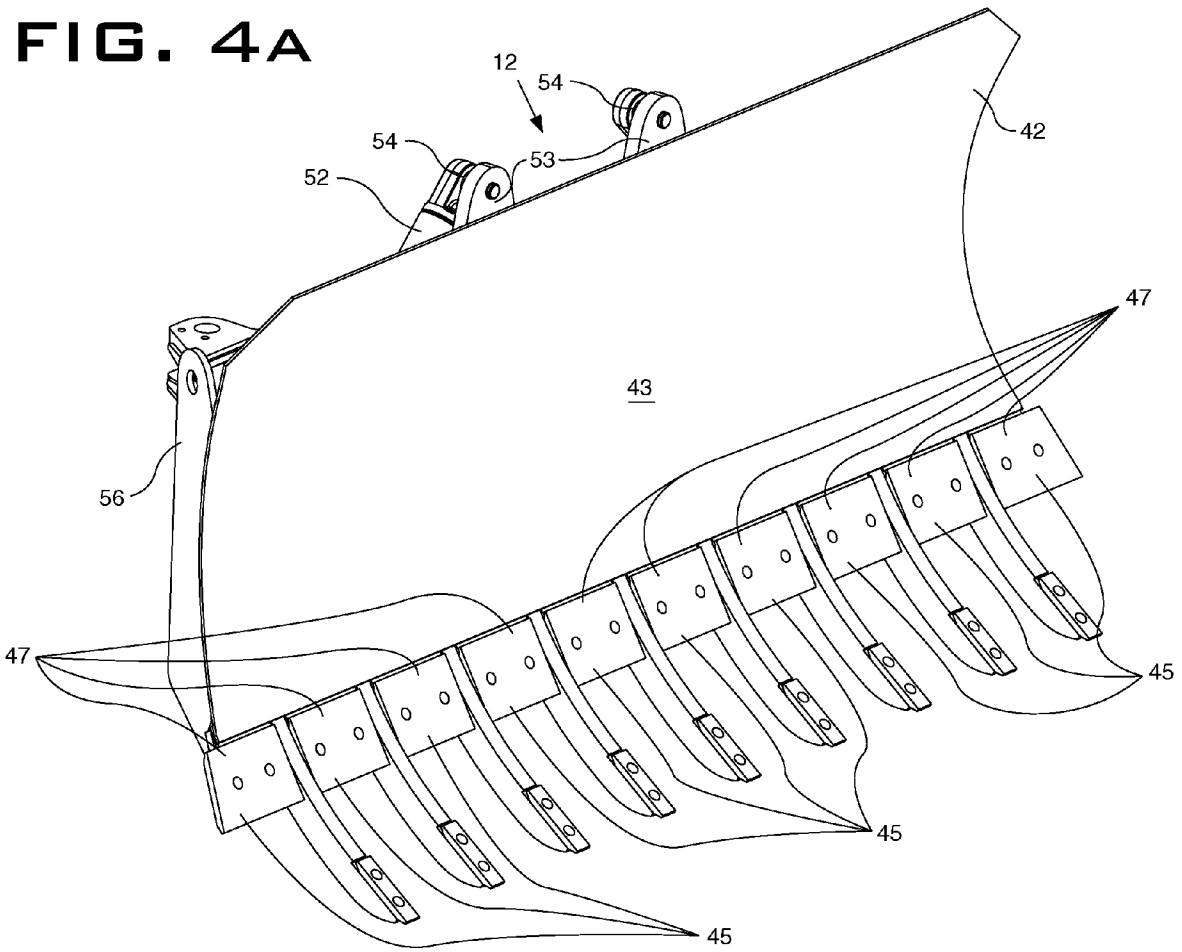
FIGS. 4A, 4B, and 4C illustrate various isometric views of an embodiment of the adjustable blade rake of FIG. 1 having the rake tines fully extended
Figure 4B:
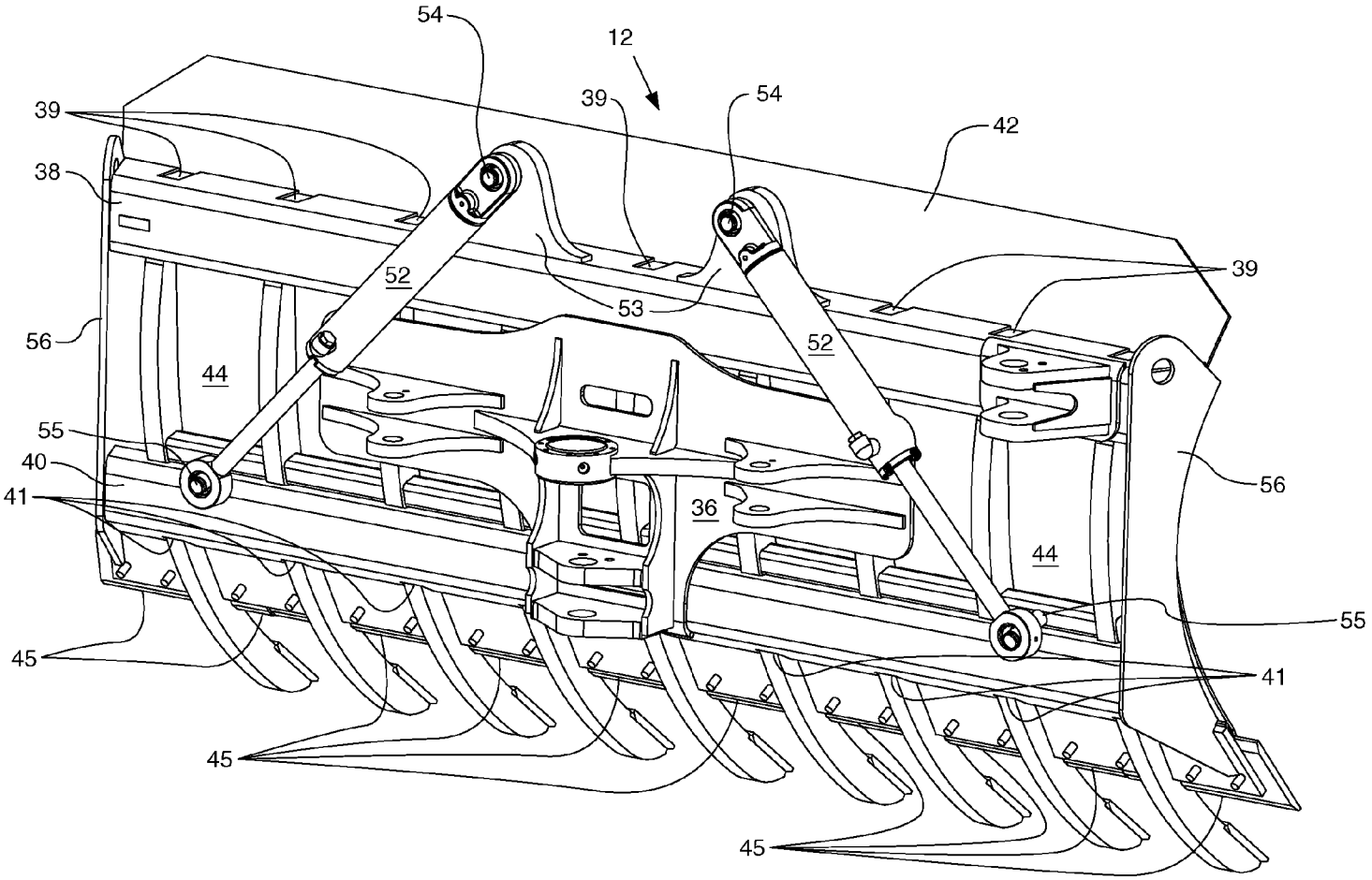
Figure 4C:
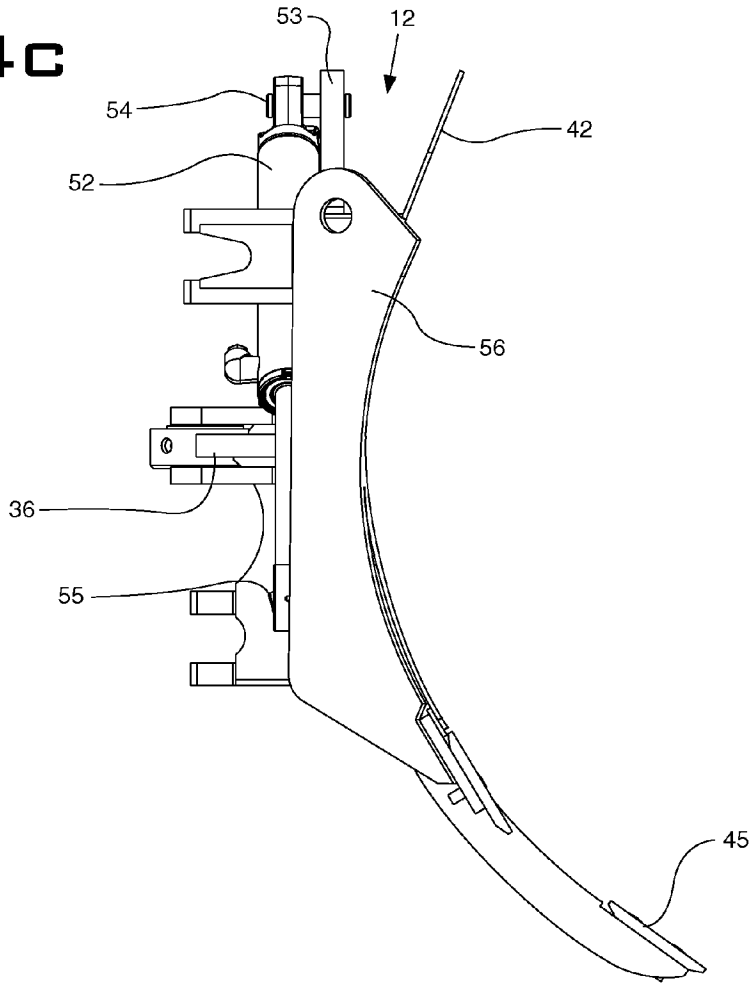

Accordingly, the tines 46 are adjustable and can all be raised together to a fully refracted position, as shown in FIGS. 2A, 2B, and 2C, lowered to a partially extended position, as shown in FIGS. 3A, 3B, and 3C, or lowered to a fully extended position, as shown in FIGS. 4A, 4B, and 4C. A lifting device 52 (e.g., a hydraulic cylinder) is coupled between cross bar 50 and lobes 53 that are attached to backup plate 38. As should be readily understood, the lifting devices 52, when configured as hydraulic cylinders, receive a pressurized fluid from a hydraulic system (not shown) powered by the power system 14 to extend and retract an extendable bar.

To facilitate sliding the tines 46 in the slots 39, 41, the lifting devices 52 extends and retracts. When the lifting devices 52 are retracted the crossbar 50 is pulled up toward the upper backup plate 38 and retracts the tines 46. When lifting devices 52 are extended the cross bar 50 is pushed down toward the lower backup plate 40 and extends the tines 46. Using the lifting devices 52 the tines 46 can be adjusted to any length between the fully retracted position and the fully extended position. As can be seen in FIGS. 2B, 3B, and 4B, when the tines are moved from a fully retracted position (e.g., FIG. 2B) to a fully extended position (e.g., FIG. 4B), the lifting device 52 moves from a more horizontal position to a more vertical position with respect to the orientation shown in these figures.

Because the tines 46 and the slots 39, 41 follow a profile of the moldboard 42, the tines tend to travel in an arcuate path when extended. Accordingly joints 54 and/or 55 may be formed as ball joints to allow multi-dimensional motion between the lifting devices 52, the lobes 53 and the crossbar 50 as the tines 46 are extended and retracted.

The adjustable blade rake 12 also includes side plates 56 attached to opposite sides of the moldboard 42. The side plates 56 are formed of a rigid material, such as steel, iron, or other material. In an embodiment, the side plates 56 may be formed of a ground engaging material. Similar to the ground engaging tools 45, 47, the side plate 56 may be fixedly or removably attached to the adjustable blade rake 12 (e.g., upper backup plate 38, lower backup plate 40, and/or moldboard 42) via welding, brazing, riveting, bolting, or any other suitable means. In use, the side plates 56 provide structural strength to the adjustable blade rake 12. In another embodiment, the side plates 56 may extend forward of the front side 43 of the moldboard 42 and may assist in cutting sides of material to be moved by machine 10.

Figure 5:
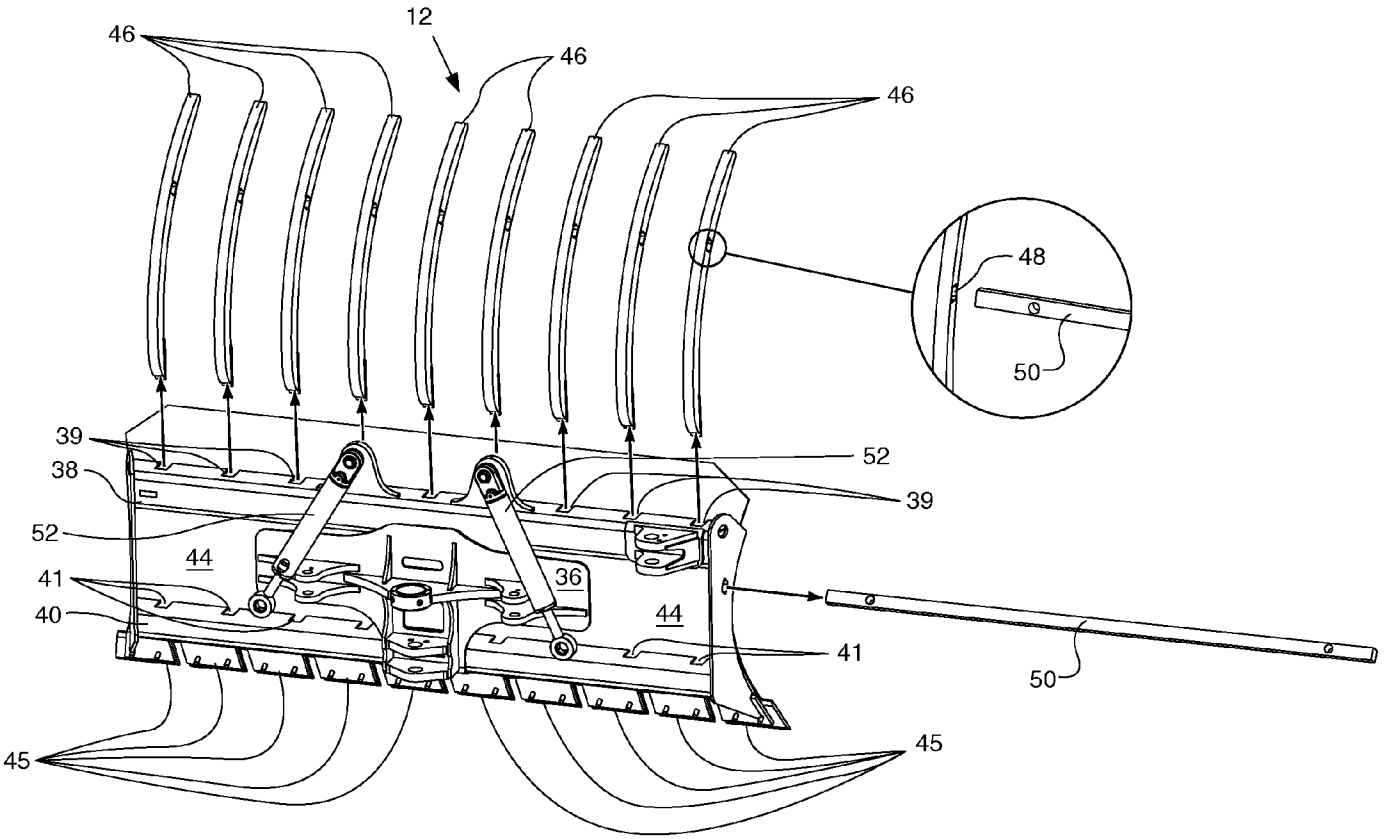
FIG. 5 illustrates an exploded view of an embodiment of the adjustable blade rake of FIG. 1 having the rake tines removed.

FIG. 5 illustrates an exploded view of an embodiment of the adjustable blade rake 12 having the rake tines 46 removed. Removing the lifting devices 52 from the crossbar 50 at joints 55 allows the cross bar to be removed from the tine crossbar apertures 48 of each tine 46. With the crossbar 50 removed, the tines 46 can be lifted upward and out of slots 39 and 41. The tines 46 (or replacement tines) may then be placed in the slots 39 and 41 and the crossbar 50 slid back through tine crossbar apertures 48. The lifting devices 52 are then reattached to the crossbar. As should be understood, pins, bolts, rivets, keeper rings, and/or other devices (not shown) may be used to keep the crossbar 50 in place through the tine crossbar apertures 48, tying the tines 46 together.

Figure 7:
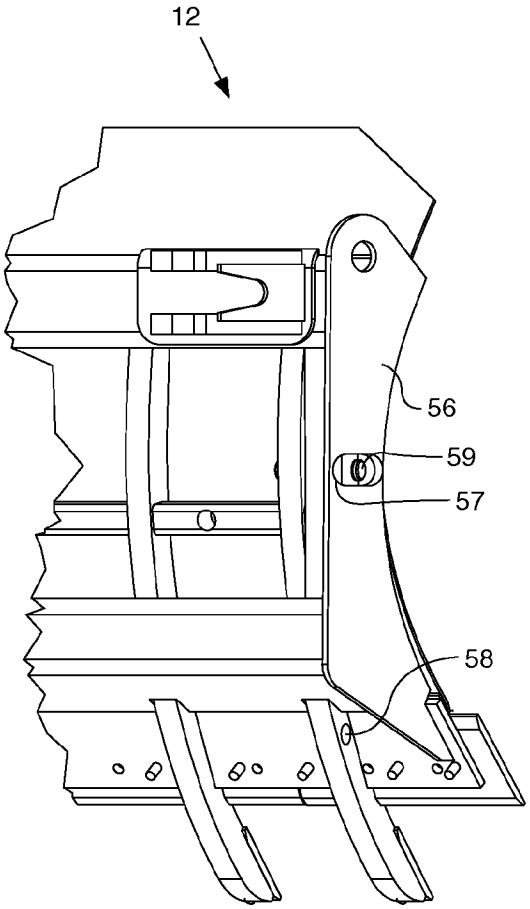
FIGS. 6 and 7 illustrate various isometric partial views of an embodiment of the adjustable blade rake of FIG. 1 having manually adjustable rake tines.
Figure 6:
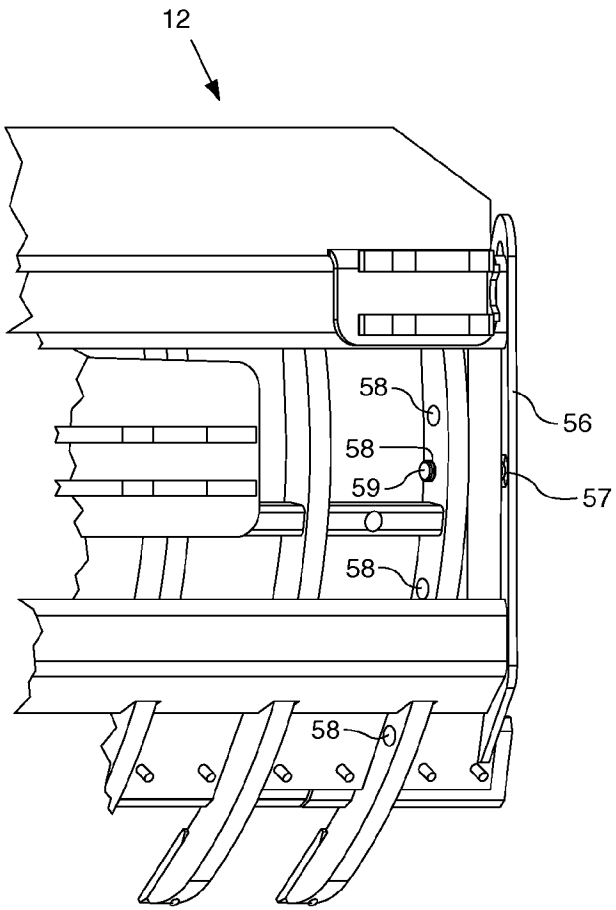

FIGS. 6 and 7 illustrate various isometric partial views of an embodiment of the adjustable blade rake 12 having manually adjustable rake tines. This embodiment may be used in addition to or as an alternative to embodiments using the lifting devices 52 to adjust extension and retraction of the tines 46. In this manual adjustment style, the side plate(s) 56 include a side plate aperture 57 through the side plate 56. The side plate aperture 57 aligns with a number of tine adjustment apertures 58 formed through one or both of the end tines located proximate the side plates 56. When the tines 46 are adjusted to a desired extension length a tine adjustment aperture 58 aligns with the side plate aperture 57. When these apertures 57, 58 align, a pin 59 is inserted through the apertures 57, 58 and held in place through the apertures 57, 58 to keep the tines 46 at the desired extension length. Any desirable means for keeping the pin 59 in place may be used with the pin 59.

In operation, an operator may remove pin 59 to allow the tines 46 to raise or lower in the slots 39, 41. Then, the operator can raise or lower the adjustable blade rake 12 using lift arms 18 to position the tines 46 at the desired extension length. After the tines are at the desired extension length and the apertures 57, 58 are aligned, the operator then inserts the pin 59 through the apertures 57, 58 to hold the tines 46 at the desired extension length.

INDUSTRIAL APPLICABILITY

The present disclosure relates generally to a machine work tool. Specifically, the present disclosure relates to an adjustable blade rake system configured to couple to a machine. The blade rake assembly includes an adjustable depth feature that allows use of the blade, the rake, or the blade and rake in combination, without the need to remove the blade to add a rake and also without the need to assemble and disassemble a traditional pivoting rake to the blade.

For example, in one embodiment, a machine operator can operate the blade, the rake, or the blade and the rake in combination by extending and retracting hydraulic cylinder lifting device configured to raise and lower the rake tines, which are embedded with structural backup plates behind the blade moldboard. The operator can control the depth of the rake infinitely within the range of rake travel using the hydraulic cylinder. In an alternative embodiment, a manual version is configured such that the rake tine depth adjustment is made at specific intervals by pinning the tines at selected heights.

Accordingly, the adjustable blade rake of the present disclosure provides a compact rake design, which does not require removal from the blade to use the blade, and does not interfere with the operators view above and in front of the blade as do traditional rakes. Furthermore, the rake may be used similar to a traditional rake (e.g., moving brush and material with the tines fully extended), or the rake may be used with the tines slightly extended as an aid in ripping soil and/or sod when dozing hard earth. Furthermore, the blade may be used without the rake when the tines are fully retracted.

It will be apparent to those skilled in the art that various modifications and variations can be made to the disclosed adjustable blade rake. Other embodiments will be apparent to those skilled in the art from consideration of the specification and practice of the disclosed adjustable blade rake. It is intended that the specification and examples be considered as exemplary only, with a true scope being indicated by the following claims and their equivalents.

What is claimed is:

1. An adjustable blade rake comprising:

a mounting plate configured to mount to a machine;

a backup plate coupled to the mounting plate, the backup plate having a plurality of slots;

a moldboard having a front side and a rear side, the front side defining a curved surface, the rear side of the moldboard attached to the backup plate;

a plurality of tines slidably located in the plurality of slots adjacent the rear side of the moldboard;

a crossbar coupling the plurality of tines together; and a lifting device operatively coupled to the plurality of tines and configured to slide the plurality of tines in the plurality of slots, wherein a portion of the tines when, in a fully raised position, are on or in front of the curved surface defined by the front side of the moldboard, and wherein the lifting device includes a pivoting cylinder and the cylinder pivots about an axis that intersects the moldboard.

2. The adjustable blade rake of claim 1, wherein the lifting device is a hydraulic cylinder operatively coupled between the backup plate and the crossbar.

3. The adjustable blade rake of claim 1, wherein the hydraulic cylinder adjusts from a more horizontal position to a more vertical position as it slides the plurality of tines from a retracted position to an extended position.

4. The adjustable blade rake of claim 1, wherein the plurality of tines include a ground engaging tool coupled to the plurality of tines.

5. The adjustable blade rake of claim 1, wherein the plurality of tines follow a profile shape of the moldboard.

6. The adjustable blade rake of claim 1, including a second backup plate having a second plurality of slots, the second plurality of slots aligned with the plurality of slots in the backup plate and slidably receiving the plurality of tines.

7. The adjustable blade rake of claim 1, including a side plate coupled to opposite sides of the moldboard.

8. A hydraulic rake system comprising:

a mounting plate configured to mount to a machine;

a backup plate coupled to the mounting plate, the backup plate having a plurality of slots;

a moldboard having a front side and a rear side, the front side defining a curved surface, the rear side of the moldboard attached to the backup plate;

a plurality of tines slidably located in the plurality of slots adjacent the rear side of the moldboard;

a crossbar coupling the plurality of tines together; and a hydraulic cylinder operatively coupled to the plurality of tines and configured to slide the plurality of tines in the plurality of slots between a retracted position and an extended position in the slots, wherein a portion of the tines when, in a fully retracted position, are on or in front of the curved surface defined by the front side of the moldboard, and wherein the hydraulic cylinder maintains a substantially equal distance from the moldboard as the hydraulic cylinder pivots during retraction and extension of the tines.

9. The hydraulic rake system of claim 8, wherein the hydraulic cylinder is coupled between the backup plate and a lobe on the crossbar.

10. The hydraulic rake system of claim 8, wherein the hydraulic cylinder pivots as it slides the plurality of tines from a retracted position to an extended position.

11. The hydraulic rake system of claim 8, wherein the moldboard includes a ground engaging material coupled to a lower portion of the moldboard and the plurality of tines includes a ground engaging tool coupled to a lower portion of the plurality of tines.

12. The hydraulic rake system of claim 8, wherein the plurality of tines have a profile shape substantially similar to a profile shape of the moldboard.

13. The hydraulic rake system of claim 8, including a second backup plate coupled to the mounting plate, the second backup plate having a second plurality of slots, the second plurality of slots aligned with the plurality of slots in the backup plate and slidably receiving the plurality of tines.

14. The hydraulic rake system of claim 8, including a side plate coupled to opposite sides of the moldboard, the side plate formed from a ground engaging material.

15. A machine comprising:

a frame;

a power system supported by the frame;

a propulsion system coupled to the frame and an engine, the propulsion system configured to propel the machine; and an adjustable blade rake coupled to the frame, the adjustable blade rake including;

a mounting plate configured to mount to a machine;

a backup plate coupled to the mounting plate, the backup plate having a plurality of slots;

a moldboard having a front side and a rear side, the front side defining a curved surface, the rear side of the moldboard attached to the backup plate;

a plurality of tines slidably located in the plurality of slots adjacent the rear side of the moldboard; a crossbar coupling the plurality of tines together; and a lifting device operatively coupled to the plurality of tines and configured to slide the plurality of tines in the plurality of slots, wherein a portion of the tines when, in a fully retracted position, are on or in front of the curved surface defined by the front side of the moldboard, and wherein the lifting device includes a pivoting cylinder and the cylinder pivots about an axis that intersects the moldboard.

16. The machine of claim 15, wherein the lifting device is a hydraulic cylinder operatively coupled between the backup plate and the crossbar.

17. The machine of claim 15, wherein the hydraulic cylinder adjusts from a more horizontal position to a more vertical position as it slides the plurality of tines to from a retracted position to an extended position.

18. The machine of claim 15, wherein the plurality of tines include a ground engaging tool coupled to the plurality of tines.

19. The machine of claim 15, wherein the plurality of tines follow a profile shape of the moldboard.

20. The machine of claim 15, including a second backup plate having a second plurality of slots, the second plurality of slots aligned with the plurality of slots in the backup plate and slidably receiving the plurality of tines.

* * * * *